United States Patent [19]

Millheim et al.

[11] Patent Number: 4,535,972

[45] Date of Patent: Aug. 20, 1985

[54] SYSTEM TO CONTROL THE VERTICAL MOVEMENT OF A DRILLSTRING

[75] Inventors: Keith K. Millheim, Terlton; Tom M. Warren, Coweta, both of Okla.

[73] Assignee: Standard Oil Co. (Indiana), Chicago, Ill.

[21] Appl. No.: 549,846

[22] Filed: Nov. 9, 1983

[51] Int. Cl.[3] ..... B66C 1/00

[52] U.S. Cl. ..... 254/277; 254/392; 173/4

[58] Field of Search ..... 254/277, 900, 275, 392; 173/4

[56] References Cited

U.S. PATENT DOCUMENTS

| | | | |
|---|---|---|---|
| Re. 28,218 | 10/1974 | Hanes et al. | 254/900 X |
| Re. 29,564 | 3/1978 | Larralde et al. | 254/900 X |
| 3,653,635 | 4/1972 | Bates et al. . | |
| 3,718,316 | 2/1973 | Larralde et al. | 254/900 X |
| 3,793,835 | 2/1974 | Larralde | 60/413 |
| 3,871,622 | 3/1975 | Larralde et al. . | |
| 3,905,580 | 9/1975 | Hooper . | |
| 3,912,227 | 10/1975 | Meeker | 254/900 X |

OTHER PUBLICATIONS

F. S. Young, *Computerized Drilling Control,* Sep. 29, 1968.

*Primary Examiner*—Stuart S. Levy
*Assistant Examiner*—Katherine Jaekel
*Attorney, Agent, or Firm*—Scott H. Brown; Fred E. Hook

[57] ABSTRACT

A system for controlling the vertical movement of a drillstring and which is removably interconnected with a conventional drill rig. The system includes at least one fluidic cylinder and piston assembly removably connected at an upper end to a support, such as the rig's traveling block assembly, and at a lower end to the drillstring. A pump is operatively connected to the cylinder and piston assembly and a control valve device is provided to control the flow of the fluid to and from the cylinder and piston assembly. A computing device is in operative communication with a data measurement system and the control valve device and is used to automatically control the movement of the drillstring in response to data, such as WOB, received from the data measurement system.

13 Claims, 4 Drawing Figures

SYSTEM TO CONTROL THE VERTICAL MOVEMENT OF A DRILLSTRING

BACKGROUND OF THE INVENTION

1. Field of the Invention

The present invention relates to a system to control the vertical movement of a drillstring within a drill rig and, more particularly, to such a system which is removably insertable into a conventional drill rig, such as one having cable draw works.

2. Setting of the Invention

In rotary drilling of wellbores, it is desirable to continue the drilling operation with a particular drill bit as long as possible to prevent unnecessary trips out of the wellbore to change drill bits; these trips for bit changes can dramatically increase the cost of the drilling operation. Several new types of drill bits have been developed which have much longer operating lives than previously developed bits, however, it has been found that these new drill bits, and especially polycrystalline diamond bits, are very sensitive to the weight-on-bit (WOB), that is, the optimum penetration rate of these new bits falls within a narrow range of WOB. The diamond cutters on these drill bits are rapidly destroyed if the WOB is too high due to either a sudden change in the formation or by a WOB addition that is in too large of an increment. When using these new drill bits, it is important to closely monitor the WOB to achieve the maximum life and efficiency of these drill bits.

Further, these new drill bits have been found to have greater penetration rates at RPM's higher than the usual drill bits and at an RPM which is higher than normally used with conventional rotary tables. Therefore, these new drill bits are often used with high RPM downhole turbines and motors. Unfortunately, these downhole turbines and motors are very sensitive to torque caused by rapid changes in WOB. For optimum performance when using a downhole turbine or motor, the WOB is preferably controlled to within a tolerance of less than about ±200 lbs. It has been found, however, that drill rigs which use a conventional cable draw works are not very accurate in controlling WOB because the cables have a certain amount of elasticity which can cause a surge in WOB, as well as the brake-type feed system on the cable draw works is usually human controlled and thus is not very accurate. It has been found that even with experienced drilling operators, the WOB can only be controlled consistently to within a tolerance of no more than about ±700 lbs, which is not acceptable in utilizing the high RPM downhole turbines and motors and/or these new drill bits.

Various devices have been developed to control the WOB; these include designing in finer tolerances in the cable draw works and gearing, as well as automatic brake-type feed systems. However, all of these devices are not accurate enough for use with the new drill bits and for use with certain high RPM downhole turbines and motors. Another type of WOB control device includes a monitor and alarm system whereby the WOB and RPM of the drillstring or the drill bit is electronically monitored, and if either of these vary outside of a preset range, then either an alarm will sound, or a microprocessor can be included to control the draw works operations and the rotary table to adjust the WOB and RPM. These WOB control devices are very expensive and have not been effective in the field due to high maintenance and, more importantly, still include the previously discussed problems inherent with a cable draw works. Another WOB control device on a drill rig is a large, long stroke hydraulic cylinder and piston assembly used in place of the cable draw works, and are called hydraulic drill rigs. These hydraulic drill rigs have not found favor in the industry and not been utilized due to their high cost and certain inherent problems with such large hydraulic systems.

Other hydraulic systems have been developed for control of WOB and have been used in offshore drilling operations, and are called "heave compensators" used to prevent the heaving motion of a drillship from affecting the WOB of the drillstring. Such hydraulic systems are disclosed within U.S. Pat. Nos. 3,653,635; 3,718,316; 3,793,835; No. Re. 29,564; and 3,871,622. All of these patents disclose heave compensators to maintain a constant WOB for use with cable draw works; however, there is no disclosure or suggestion in any of these patents of a system which utilizes a fluidic cylinder and piston assembly for precisely controlling the vertical movement of the drill string and which is easily installed and removed from a conventional drill rig having cable draw works. Further, there is no suggestion or disclosure within any of these patents of such a removable fluidic cylinder and piston assembly for controlling the vertical movement of a drill string in response to data received from a data measurement system.

A different type of heave compensator is disclosed in U.S. Pat. No. 3,905,580 and includes a modified cable draw works used with a hydraulic assembly for WOB adjustment. There is no disclosure or suggestion within this patent of a fluidic cylinder and piston assembly for precisely controlling the vertical movement of a drillstring and, which is easily installed and removed from a conventional drill rig having cable draw works. Further, there is no disclosure or suggestion within this patent of such a removable fluidic cylinder and piston assembly for controlling the vertical movement of a drill string in response to data received from a data measurement system.

The concept of controlling the movement of a drillstring in response to data received from data measurement system is disclosed in an article written by F. S. Young, Jr., Humble Oil and Refining Corporation, and presented at the SPE 43rd Annual Fall Meeting in Houston, Tex., Sept. 29–Oct. 2, 1968. However, Young does not disclose or suggest the use of a fluidic cylinder and piston assembly for precisely controlling the movement of a drillstring, nor does the Young article disclose or suggest such a system which is easily connected to and removed from a conventional drill rig having cable draw works.

SUMMARY OF THE INVENTION

The present invention provides a system for controlling the vertical movement of a drillstring associated with a conventional drill rig in response to data received from a data measurement system and is contemplated to overcome the foregoing disadvantages. The system includes at least one fluidic cylinder and piston assembly which is removably and operatively connected at an upper end to a support on the drill rig, such as the rig's traveling block assembly, and at a lower end to the drillstring, such as through a swivel assembly. A pump supplies fluid under pressure to the piston and cylinder assembly and the flow of the fluid is controlled by a control valve. A computing device, such as a microprocessor, is in communication with a data measurement system and is operatively in communication with the control valve to control the flow of fluid. The microprocessor thus controls the vertical movement of the drillstring in response to data received from the data measurement system. In one embodiment of the present invention, the system receives data from a downhole telemetry system to control WOB and in another embodiment, the system is used to control the WOB and the RPM of the drill bit.

DESCRIPTION OF THE DRAWING

FIG. 1 is an elevational view of a system for controlling the movement of a drillstring in a drill rig, embodying the present invention, and which is connected to a traveling block assembly and a swivel assembly of a conventional drill rig.

DETAILED DESCRIPTION OF THE PREFERRED EMBODIMENT

Figure 1:
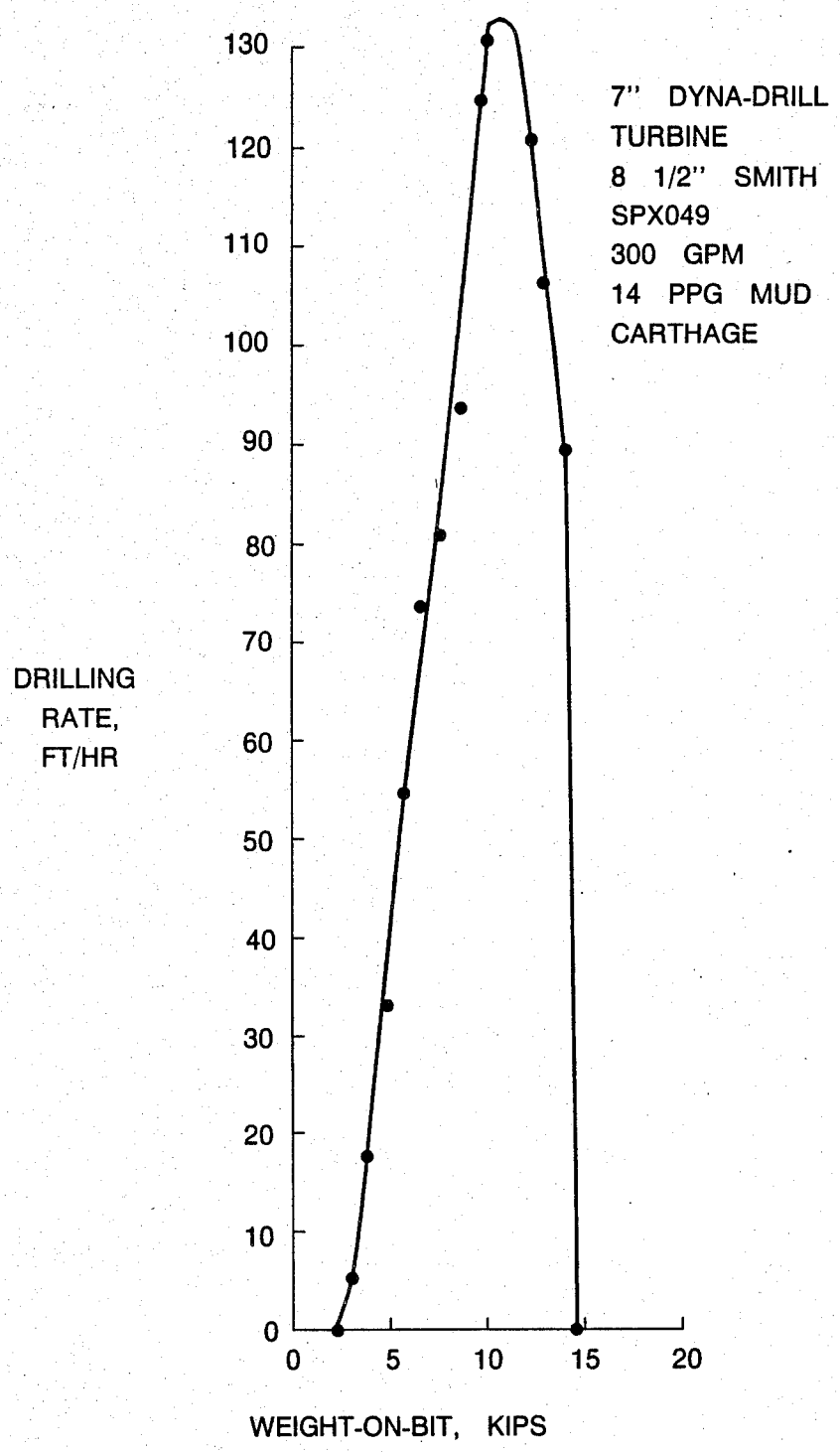
FIG. 1 is a graphical representation of the penetration rate of a polycrystalline diamond bit versus weight-on-bit (WOB).

The present invention is a system for controlling the vertical movement of a drillstring on a conventional drill rig in response to data received from a data measurement system. The system includes at least one fluidic cylinder and piston assembly which is removably and operatively connected at an upper end thereof to a support on the drill rig and at a lower end thereof to the drillstring. A pump supplies fluid under pressure to the cylinder and piston assembly and the flow of the fluid is controlled by a control valve. A computing device, such as a microprocessor, is in communication with a data measurement system and is operatively in communication with the control valve to control the flow of fluid and thus the vertical movement of the drillstring in response to the data received from the data measurement system.

As used throughout this discussion, the term "controlling the vertical movement of a drillstring" comprises and includes the concept of raising, lowering, and advancing the drillstring through the earth and also maintaining the WOB within a desired range. Also, the term "data measurement system" shall mean any system or device which gathers information, such as RPM, torque, WOB and the like, from surface rig sources, downhole sources or combinations of these, and which can be used in controlling certain drilling operations. One such data measurement system is a Measurement While Drilling (MWD) system marketed by The Analyst, a division of Schlumberger Company.

The present invention can be used in conjunction with any conventional drill rig, including those which have cable draw works or equivalent. The present invention is primarily used for precisely controlling the vertical movement of the drillstring to maintain the WOB within an optimum predetermined range for the greatest penetration rate for a particular drill bit and further to decrease the chances of destruction of the drill bit. The present invention can be used with any bit rotation arrangement, be it rotary table, power swivel, downhole motor, turbine, or the like. Due to the critical WOB and RPM tolerances of certain downhole motors and turbines, it is preferable that the present invention be used with such downhole motors turbines alone or with the new longer life drill bits, such as diamond bits, insert bits, and polycrystalline diamond bits.

The present invention can be controlled manually by a drilling operator in response to some visual indication, such as from a chart recorder, gauges and the like, to control the flow of fluid to the cylinder and piston assembly. However, the system of the present invention is preferably controlled in an automatic body by a computing device, such as a microprocessor, which has certain WOB ranges inputted therein by the operator for the particular type of drill bit to be used. Most preferably, the system includes a software-based control program or algorithm which is included in memory associated with the microprocessor and utilized. In the control sequence, several interactive laboratory models, such as models for determining formation hardness effects on drill bit penetration, hold drag, RPM models, and the like, are used to receive data from the data measurement system and continuously interactively update the desired WOB and RPM ranges or set points. After this system has been activated and if the WOB varies outside of the desired preset ranges or the continuously updated set points then the computing device causes corrective action to be taken, such as raising the drillstring, lowering the drillstring, adding or subtracting WOB and/or adjusting the RPM of the drill bit. WOB data can be inputted into the computing device continuously or on a preset time delay and thereafter the control program can compute the correct WOB, RPM, torque, etc. for an optimum penetration rate for the particular drill bit. The computing device can then adjust the movement of the drillstring to the desired WOB to achieve the optimum penetration rate, without the need for human interaction.

Figure 2:
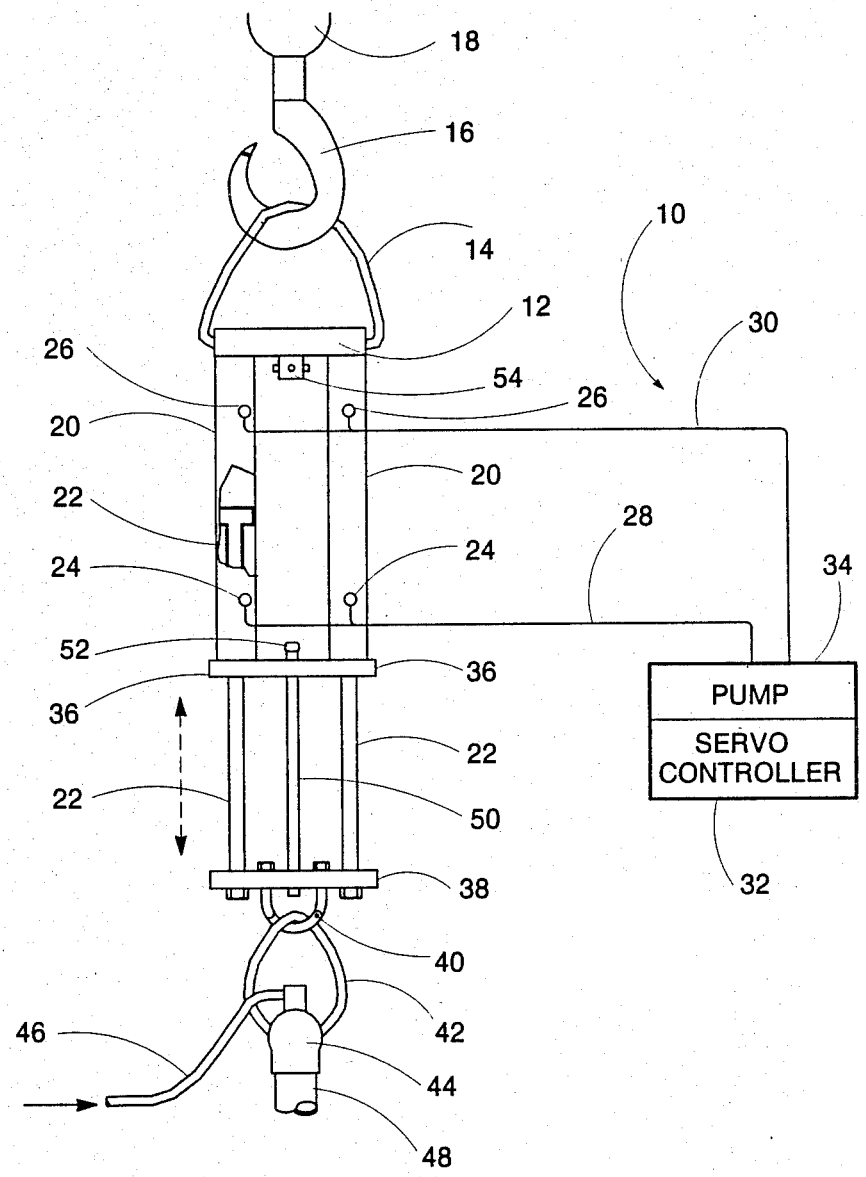
Figure 3:
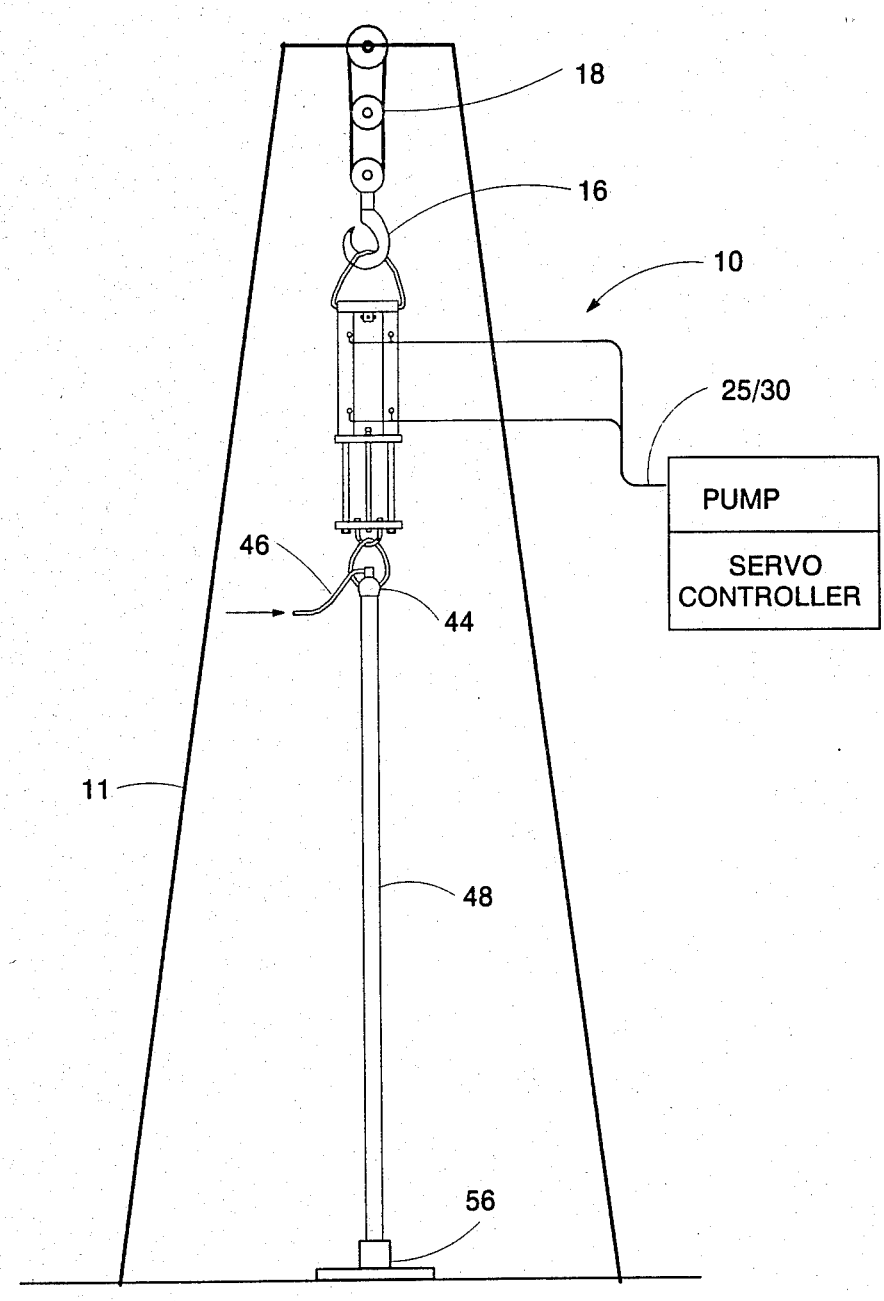
FIG. 3 illustrates one embodiment of the present invention removably connected to the draw works of a conventional drill rig.

One embodiment of the present invention is shown in FIGS. 2 and 3, wherein reference character 10 generally indicates the drillstring advancement system of the present invention which is connected to a conventional drill rig 11. The system 10 includes an upper horizontal brace 12, which has a loop of cable 14 or the like connected thereto. The cable 14 is provided for removable interconnection with a lifting hook 16 attached to a lower end of a support, such as a traveling block assembly 18, of the drill rig 11. Connected to the underside of the brace 12 is at least one, and preferably at least two, hydraulic or pneumatic cylinders 20, each with internal pistons 22 connected for reciprocal motion within the cylinders 20, as is well known in the art. Pressurized fluid, such as hydraulic fluid or air, is introduced into the cylinders 20 through ports 24 to retract the pistons 22 and the fluid is released through ports 26. A conduit 28 and a conduit 30 provide fluid to and receive fluid from the ports 24 and 26 respectively, and are operatively connected through a servo controller or control valve 32 to a hydraulic or pneumatic pump device 34, such as a drill rig's hydraulic system or an auxiliary pumping unit as desired. The amount of and direction of the flow of fluid through the conduits 28 and 30 is controlled by the control valve 32, as is well known in the art, and is accomplished manually or automatically.

A lower end of the cylinders 20 are connected to a second horizontal brace 36, which is provided with at least two vertical bores (not shown) extending therethrough and through which the pistons 22 extend. A lower end of each piston 22 is connected to a lower yoke-type brace 38 which has a downward extending hook or C-clamp connection device 40 into which is removably connected a cable or bail 42 of a conventional drill rig's swivel assembly 44. Drilling fluids are provided through a conduit 46 to the swivel assembly 44 and through a drillstring 48 to the drill bit (not shown), again as is well known in the art.

In one embodiment of the present invention, the system 10 can be installed on the drill rig 11 in the following manner. The bail 42 on the swivel assembly 44 is disconnected from the hook 16 on the traveling block 18 by lowering the drill rig's draw works. The cable 14 is connected to the hook 16 and the system 10 is raised by raising the traveling block 18 until the bail 42 can be connected to the C-clamp connector 40. Thereafter, the conduits 28 and 30 are connected to the control valve 32 and other conduits (not shown) are connected from the control valve 32 to the pump 34. This installment procedure will obviously vary from rig type to rig type.

The fluidic cylinder and piston assemblies can have sufficient stroke to be retracted to a height or level sufficient for the addition of one length of pipe, such as no less than 35 ft. Preferably, to increase the speed of the drilling operation, the stroke will be sufficient for the addition of a "double", i.e., two single 30 ft lengths of drill pipe. Also, the fluidic cylinder and piston assemblies need to have sufficient lifting capacity to lift a drillstring, such as a capacity to lift up to about 500,000 lbs.

Fluid flow restriction devices (not shown) can be included in the conduits 28 and 30, as is known to those skilled in the art, to prevent the rapid lowering of drillstring 48 in the event of a fluid pressure loss. Also, in one embodiment, a vertical rod 50 is connected to the brace 38 and passes through a bore (not shown) in the second brace 36. Affixed to an upper end of the rod 50 to a catch mechanism 52, such as a spring clamp, hook, or the like, and affixed to a lower portion of the first brace 12 is a cooperative catch mechanism 54. When the drillstring 48 is fully raised the catch mechanism 52 is received into the mechanism 54 and the full weight of the drillstring 48 is then born by the catch mechanisms 52 and 54 and the rod 50, and not by fluid pressure within the cylinder and piston assemblies. When the drillstring 48 is to be lowered, the catch mechanism 54 is either manually or automatically caused to release the catch mechanism 52.

Figure 4:
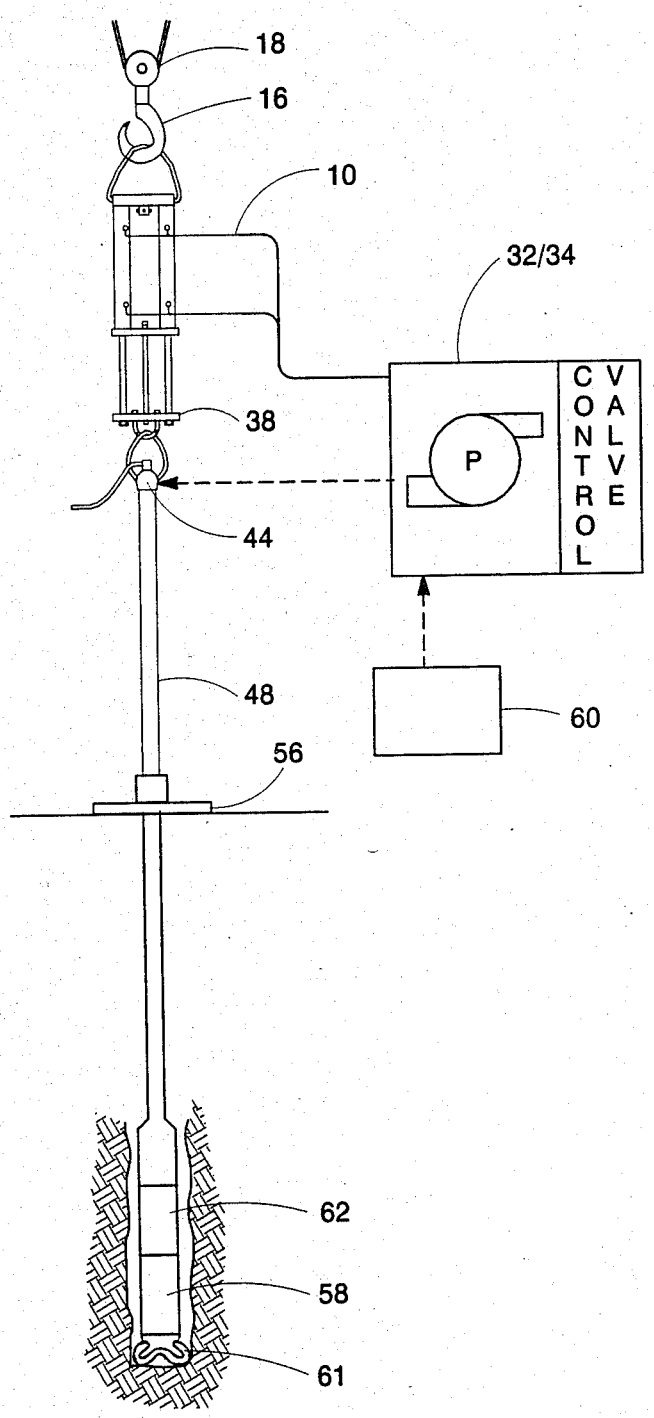
FIG. 4 is a semidiagramatic representation of one embodiment of the present invention removably connected to a drill rig and which is in operative communication with a downhole measurement system for controlling the advancement of the bit.

The system can be used with a rotary table 56 (FIGS. 3 and 4) to impart rotary motion to the drillstring 48 and the drill bit, a power swivel to rotate the drillstring 48, or a downhole motor or turbine 58 to rotate a drill bit 60 (FIG. 4) by drilling fluid pressure introduced into the drillstring 48 through the conduit 46 and the swivel assembly 44, as is well known.

The parameter to be measured and thereby controlled within the system 10 is usually WOB, which can be obtained from conventional WOB indicators connected to the cable draw works of the drill rig 11, a load cell (not shown) mounted to the brace 38, monitoring the internal pressure of the cylinders 20, and/or a downhole telemetry system, such as a MWD system. The WOB data can be displayed on a driller's control panel on the drill rig 11 and the drilling operator can manually adjust the control valve 32 in response to the indicated WOB.

It shold be understood that WOB measurements from a load cell or the internal pressure of the cylinders 20 will indicate only the axial load of the drillstring 48 from which WOB is calculated. A downhole measurement of WOB is considered the most accurate and therefore is preferred. The difference between a surface measurement of WOB and a downhole measurement of WOB can provide valuable information as to the amount of friction between the drill bit and the wellbore, reflecting such things as a dogleg, the existence of change in rock types, etc.

As stated previously, the preferred embodiment of the system 10 includes a computing device 60, such as a microprocessor, in which is stored certain programs or algorithms for controlling the advancement of the drillstring. The computing device receives WOB data from a conventional WOB indicator or load cell and/or is in operative communication with a downhole telemetry system 62 (FIG. 4) connected to the drillstring. The computing device 60 is also in operative communication with the control valve 32 to control the operation of the valve 32 via a solenoid or the like. The WOB data is converted to digital format by an analog to digital converter and is sampled every preset time increment or is only sent upon preset time increments. The digital measurement is then compared, i.e., greater than or less than, to the inputted (by the operator) desired WOB for that particular type and model of drill bit, lithology to be encountered, and predetermined RPM of the drill bit. If the WOB is less than the desired range than the computing device generates a signal which is sent to a solenoid on the control valve 32 and causes the control valve 32 to decrease the pressure by a certain increment of fluid being pumped to the pistons 22 through the conduit 30 or to bleed off more fluid. If the WOB is greater than the desired range, then the computing device generates a signal to cause the control valve 32 to increase the pressure by a certain amount being pumped to the pistons 22 through the conduit 30. The stored programs can also generate simple preset ranges or limits so that when the operator initiates the automatic control sequence the vertical movement of the drillstring 48 is controlled by the computing device 60 because the WOB is automatically maintained within these certain preset limits.

Once the pistons 22 have been fully extended, the rotation of the drill bit will cease manually or automatically and the pistons 22 are retracted and another length of pipe will be added between the swivel 44 and the drillstring 48, as is known in the art.

The computing device 60 can be housed in a protective enclosure anywhere on the drill rig 11. Preferably, the computing device 60 is mounted in or at the drilling operator's control panel for ease of access and environmental concerns. Included with the computing device 60 are the necessary control dials and alarm lights and the like for use with the pump 34 and the control valve 32. Also, a keyboard and CRT display screen is provided to allow the operator to input the desired information regarding the drill bit into the computing device 60.

The computing device 60 can also be placed in operative communication with the drilling fluid pumps if a downhole motor or turbine is used, the controller of a power swivel assembly, or the control of the rotary table, so that along with WOB, the computing device 60 can control the RPM of the drill bit as well. Drill bit RPM data from any conventional source can be introduced into the computing device 60 and used by the programs or algorithms to achieve an optimum WOB and RPM combination for a particular drill bit. The RPM algorithms can be standalone or can be used with the WOB algorithms, or the RPM algorithms can be made part of the WOB algorithms so that for given preset parameters determined by the drilling operator, the control device 60 will calculate and adjust the necessary equipment to achieve the optimum WOB and RPM for an optimum penetration rate.

The present invention has other uses other than for controlling the vertical movement of the drillstring. For example, an invasion of fluid into the wellbore, such as a potential well kick, can be sensed by any conventional deletion alarm or device and relayed to the computing device which then automatically halts the drilling, and raises the drillstring to a position where blowout preventers can be manually or automatically closed. The starting of an undesired hole curvature or dogleg can be corrected by having the system automatically halt the drilling upon detection of this and retract the drillstring and ream the wellbore over the portion of the hole curvature buildup. The system can be used to respond to signals from the surface and/or downhole sensors and can control the rate of lowering the drillstring over a test interval, thereby sampling the WOB and determining the optimum WOB for a certain penetration rate, which will enable automatic drilloff tests to optimize the WOB only, WOB and rotary speed only, and WOB and rotary speed and fluid pumping rates. The system can be utilized to stop the rotation of the drillstring upon sensing extreme torque variation or bit sticking. Also, the system can be used to advance the drill bit and control the RPM to maintain a given course in controlled directional drilling.

Whereas the present invention has been described in particular relation to the drawings attached hereto, it should be understood that other and further modifications, apart from those shown or suggested herein, may be made within the scope and spirit of this invention.

We claim:

1. A system for controlling the weight on a drill bit connected to a lower end of a drillstring and connectable to a drill rig having cable draw works, comprising:

at least one fluidic cylinder and piston assembly removably and operatively connected at an upper end thereof to a support of the drill rig and at a lower end thereof to a drillstring;

pump means for providing fluid to said fluidic cylinder and piston assembly;

valve means for controlling the flow of the fluid to and from said fluidic cylinder and piston assembly;

data measurement means, connected to the drillstring adjacent the drill bit, for generating a signal representative of the weight on the drill bit; and computing means, in operative communication with said valve means for controlling the operation of the fluidic cylinder and piston assembly in response to the signal received from the data measurement means to maintain the weight on the drill bit within desired limits.

2. The system of claim 1 wherein said support is a traveling block assembly on the drill rig and said lower end of said fluidic cylinder and piston assembly is removably connected to a swivel assembly, which has the drillstring attached thereto.

3. The system of claim 1 wherein said fluidic cylinder and piston assembly comprises:

a first brace having connection means for interconnection to said support;

a second brace having connection means for interconnection to the drillstring; and at least one fluidic cylinder having a piston received therein for reciprocal motion, an upper portion of said cylinder being connected to said first brace and a lower portion of said piston being connected to said second brace.

4. The system of claim 3 and including a vertical guide rod connected at one end to said second brace and slidably connected to a third brace connected to said cylinder.

5. The system of claim 4 and including a safety catch on an upper portion of said vertical guide rod and a cooperative safety catch connected to a lower portion of said first brace.

6. The system of claim 2 wherein said swivel assembly is a power swivel assembly.

7. The system of claim 1 wherein said fluidic cylinder and piston assembly includes at least one hydraulic cylinder.

8. The system of claim 1 wherein said fluidic cylinder and piston assembly includes at least one pneumatic cylinder.

9. The system of claim 2 wherein said computing means is in operative communication with means for controlling the rotation of the drill bit.

10. The system of claim 1 wherein the drill string includes a downhole turbine.

11. The system of claim 9 wherein the data measurement system includes means for generating a signal representative of bit RPM.

12. The system of claim 9 wherein the data measurement system includes means for generating a signal representative of bit torque.

13. A method of controlling the advancement of a drill bit through an underground formation in response to data received from a data measurement system, which is connected to a drillstring adjacent the drill bit, comprising:

(a) receiving weight-on-bit data from the data measurement system;

(b) comparing the weight-on-bit data received in (a) to a calculated data parameter range; and (c) adjusting the weight-on-bit to be within the calculated data parameter range by operation of a fluidic cylinder and piston assembly.

* * * * *